United States Patent [19]

Shinozaki et al.

[11] 4,099,284

[45] Jul. 11, 1978

[54] HAND SWEEPER FOR CARPETS

[75] Inventors: Mamoru Shinozaki, Tokyo; Yuichi Takahama; Hachiro Tubaki, both of Kawagoe; Kazuo Nagasawa; Yasao Mikami, both of Tokyo, all of Japan

[73] Assignee: Tanita Corporation, Tokyo, Japan

[21] Appl. No.: 770,768

[22] Filed: Feb. 22, 1977

[30] Foreign Application Priority Data

Feb. 20, 1976 [JP] Japan ..... 51-19715[U]
Mar. 16, 1976 [JP] Japan ..... 51-31880[U]

[51] Int. Cl.[2] ..... A47L 11/33
[52] U.S. Cl. ..... 15/42
[58] Field of Search ..... 15/42

[56] References Cited

U.S. PATENT DOCUMENTS

| | | | |
|---|---|---|---|
| 485,348 | 11/1892 | Leigh | 15/42 X |
| 801,882 | 10/1905 | Knell | 15/42 |
| 865,084 | 9/1907 | Deitch et al. | 15/42 |

FOREIGN PATENT DOCUMENTS

| | | | |
|---|---|---|---|
| 1,923,908 | 11/1970 | Fed. Rep. of Germany | 15/42 |

*Primary Examiner*—Edward L. Roberts

[57] ABSTRACT

Driving wheels for auxiliary rotary wheels are provided at the forward corners of a sweeper in a spaced relationship from driving wheels for a main rotary brush to provide a long wheel base.

3 Claims, 5 Drawing Figures

HAND SWEEPER FOR CARPETS

This invention relates to hand sweepers for carpets capable of sweeping dust into a dust box thereof by a rotary brush and more particularly, to a hand sweeper wherein auxiliary rotary brushes are provided at the forward corners thereof to sweep dust away from the corners of floors towards a path on which a main rotary brush passes.

A hand sweeper known heretofore is of a type that a pair of driving wheels are provided at either side thereof for frictionally engaging each of driven wheels to transmit rotation thereof to the main rotary brush and one of the driving wheels is also used to rotate an auxiliary rotary brush which is provided at either forward corner of the sweeper base. This type of hand sweeper has a disadvantage that pitching of the sweeper takes place during its backward and forward movements due to the fact that the driving wheels do not have a wheel base long enough to provide a stable support of the sweeper.

A main object of the present invention is to provide a hand sweeper which eliminates such a disadvantage set forth above.

This object is achieved by providing a hand sweeper wherein driving wheels for auxiliary rotary wheels are provided at the forward corners thereof in a spaced relationship from driving wheels for a main rotary brush to provide a wheel base long enough to support the sweeper in a stable state.

According to the invention, there is provided a hand sweeper comprising a body having a handle pivotably connected thereto, a base removably connected to said body and forming a dust box, a main rotary brush extending across said dust box, driving wheels on said base for rotating said main rotary brush to sweep dust into said dust box, auxiliary rotary brushes rotatably mounted on said base at its forward corners and each having a horizontal axis extending forwardly and outwardly of the base, driving wheels rotatably supported on said base in a spaced relationship from said driving wheels for said main rotary brush and means for transmitting rotation of said auxiliary driving wheels to said auxiliary rotary brushes to rotate them around said horizontal axes.

Further advantageous features of the present invention will become more apparent from the following description of a preferred embodiment of the hand sweeper according to the invention taken in conjunction with the accompanying drawings in which.

Figure 1:
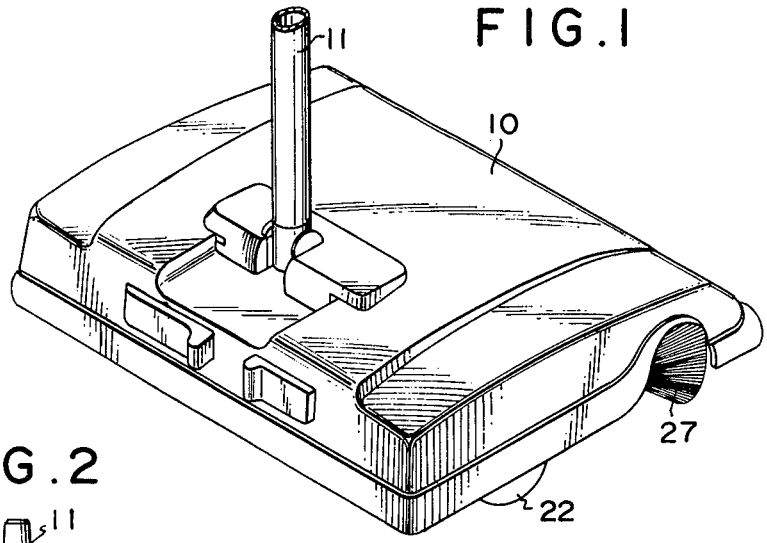
FIG. 1 shows a perspective view of a hand sweeper according to the present invention.
Figure 2:
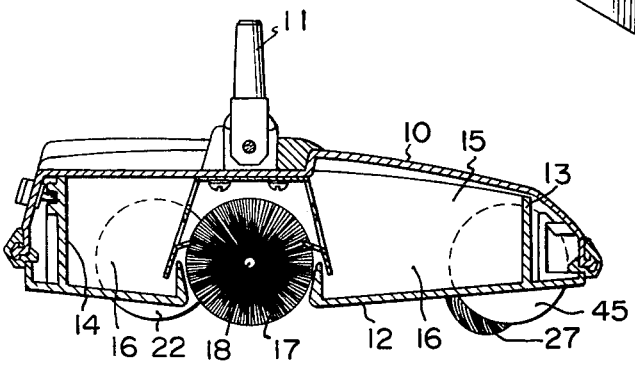
FIG. 2 shows a vertical cross-section of the hand sweeper shown in FIG. 1.
Figure 3:
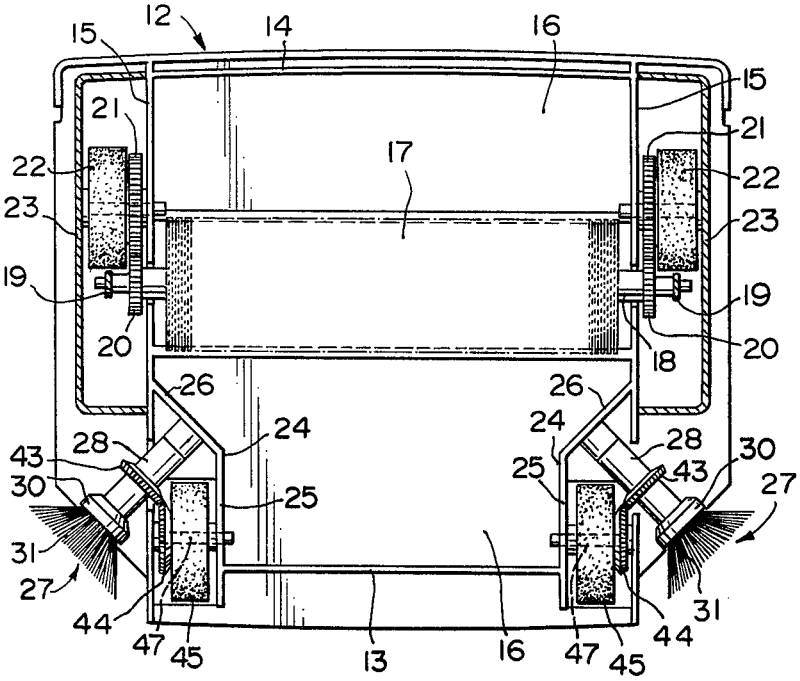
FIG. 3 shows a top plan view of a base of the hand sweeper shown in FIG. 1.

Referring to the drawings, a hand sweeper according to the present invention comprises a body 10 having a handle 11 pivotally connected to the upper surface thereof and a base 12 removably connected to the body 10 and having front and rear walls 13 and 14, and side walls 15 formed integrally therewith. Preferably, the body 10 and the base 12 are made of any suitable plastic material. The walls 13, 14 and 15 with the bottom of the base 12 define a dust box 16 across which a main rotary brush 17 extends horizontally between the side walls 15. A shaft 18 for the rotary brush extends outwardly through the side walls 15 and is rotatably supported at the outer ends thereof on bearing elements 19 and 19 projecting from the base 12. The shaft 18 is provided with a pair of gears 20 and 20, each of which meshes with a gear 21 formed integrally with a driving wheel 22 which is rotatably supported on the rearward portion of one of the side walls 15 and one of protective walls 23 projecting from the bottom of the base 12 and extending parallel to the side walls 15.

The base 12 has at its forward corner additional walls 24 inside the side walls 15, each of the additional walls 24 having a portion 25 extending parallel to the side wall 15 in a spaced relationship therefrom and an inwardly inclined wall portion 26 extending between the wall portion 25 and the side wall 15.

Figure 4:
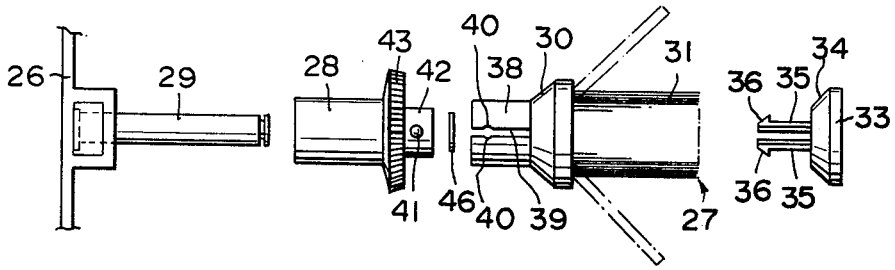
FIG. 4 shows an exploded view of parts of the auxiliary rotary brush.
Figure 5:
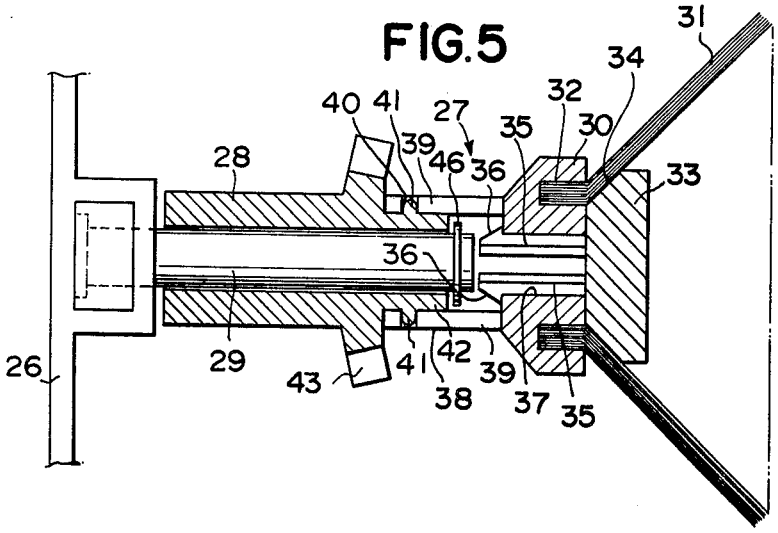
FIG. 5 shows a cross-sectional view of the auxiliary rotary brush.

Auxiliary rotary brushes 27 with axes extending forwardly outwardly of the sweeper are positioned at the forward corners of the base for sweeping dusts away from the corners of floors. As can be seen from FIGS. 4 and 5, each of the auxiliary rotary brushes 27 comprises a boss 28 rotatably mounted on a stationary horizontal shaft 29 which is fixedly supported on the inclined wall portion 26 with an axis thereof extending perpendicularly to the inclined wall portion 26, and a brush head 30 removably connected to the boss 28 and having a brush 31. Bristles of the brush 31 in an annular form have their ends inserted in an annular recess 32 formed in the brush head 30. A holder 33 is provided with an inclined abutment surface 34, for holding the annular bristles in the form of a cup and a pair of legs 35 and 35 having at their ends hooks 36 and 36. The holder 33 is connected to the brush head 30 by inserting the legs 35 and 35 into a center bore 37 formed in the brush head 30 until the hooks 36 and 36 have engaged the end face of the head 30 opposite to the brush 31. Brush head 30 is provided with a cylindrical portion 38 extending integrally from the end face thereof and having a pair of diametrically opposed slots 39 and 39 which extend along an axis of the cylindrical portion 38. Each of the slots 39 and 39 is formed with arcuate recesses 40 for receiving one of a pair of diametrically opposed projections 41 and 41 formed on an extension 42 of the boss 28. A bevel gear 43 is formed integrally with the boss 28 and meshed with a bevel gear 44 which is formed integrally with a driving wheel 45. The boss 28 is held in position on the stationary shaft 29 by a retainer ring 46 fixed on the end of the shaft 29. The brush head 30 is removably connected to the boss 28 by fitting the cylindrical portion 38 over the extension 42 with the slots 39 and 39 receiving the projections 41 and 41 and by engaging the arcuate recesses 40 with the projections 41 and 41.

Each of the driving wheels 45 and 45 is disposed in a space between the additional wall portion 25 and the side wall 15 and rotatably mounted on a shaft 47 which is fixedly supported on the wall portion 25 and the side wall 15. Thus, rotation of each of the driving wheels 45 and 45 is transmitted through the mutually meshed bevel gears 43 and 44 to the auxiliary rotary brush 27 to rotate it around the horizontal shaft 29.

It should be understood that frictional wheels may be substituted for the bevel gears as means for transmitting rotation of the driving wheels to the auxiliary rotary brushes.

In use, the sweeper according to the present invention is manually moved back and forth by operation of the handle 11 so that the driving wheels 22 and 22 are rotated to transmit their rotation through the mutually meshed geaas 20 and 21 to the main rotary brush 17, thereby sweeping dust into the dust box 16. At the same time, rotation of the forward driving wheels 45 and 45 is transmitted through the gears 43 and 44 to the auxiliary rotary brushes 27 and 27 to rotate them, thereby sweeping inwardly the dust from the opposite sides of the sweeper towards a path on which the main rotary brush 17 passes. The auxiliary rotary brushes 27 and 27 are particularly effective to sweep out the dust from the corners of floors so that the dust swept out can be swept into the dust box by the main rotary brush.

The hand sweeper according to the present invention has an advantage that it can be moved back and forth by operation of the handle under a stable condition without any pitching due to the fact that the driving wheels have a long wheel base.

According to the present invention, further, the auxiliary rotary brushes can readily be replaced by new ones when they have worn out. This is achieved by pulling out the brush head from the extension of the boss and by fitting a new brush head onto the boss extension.

We claim:

1. A hand sweeper comprising a body having a handle pivotably connected thereto, a base removably connected to said body, said base having a front end and a rear end and forming a dust box, a main rotary brush extending across said dust box, driving wheels on said base adjacent said rear end for rotating said main rotary brush to sweep dust into said dust box, auxiliary rotary brushes rotatably mounted on said base at its forward corners, each of said auxiliary rotary brushes including a horizontal shaft fixedly supported on the base and extending forwardly and outwardly from the base and at an oblique angle with respect to said main rotary brush, a boss rotatably mounted on said shaft, auxiliary driving wheels rotatably supported on said base adjacent said rear end in spaced relationship to said driving wheels for said main rotary brush, and means for transmitting rotation of said auxiliary driving wheels to said auxiliary rotary brushes to rotate them around said horizontal axes, said transmitting means including a bevel gear formed integrally with said boss, and a bevel gear formed on each of said two auxiliary driving wheels and respectively meshing with said bevel gear on said auxiliary rotary brush.

2. A hand sweeper according to claim 1, wherein said boss has an extension formed integrally therewith and a pair of diametrically opposed projections, and each of said brushes including a brush head with a cup-like brush and removably connected to said boss, said brush head having an integral cylindrical portion with a pair of diametrically opposed slots, each of said slots having arcuate recesses for receiving said projection to removably connect said brush head to said boss when said brush head has been fitted onto said extension of said boss.

3. A hand sweeper according to claim 2 wherein said cup-like brush is formed by holding bristles thereof provided on said brush head in an annular form, by means of a holder connected to said brush head.

* * * * *